United States Patent [19]

Chen

[11] Patent Number: 4,823,112

[45] Date of Patent: Apr. 18, 1989

[54] MULTI-FUNCTION ELECTRIC BELL

[76] Inventor: Wen-Sen Chen, 3F, No. 5, Long 6, Lane 421, Guang-Fuh S. Rd., Taipei, Taiwan

[21] Appl. No.: 59,861

[22] Filed: Jun. 8, 1987

[51] Int. Cl.[4] ..... G08B 19/00; G08B 3/00

[52] U.S. Cl. ..... 340/521; 340/547; 340/384 E

[58] Field of Search ..... 340/521, 547, 566, 384 E; 367/197, 199

[56] References Cited

U.S. PATENT DOCUMENTS

| | | | |
|---|---|---|---|
| 3,340,522 | 9/1967 | Chick et al. | 340/566 |
| 4,236,147 | 11/1980 | Calvin | 340/384 E |
| 4,319,228 | 3/1982 | Daniels | 340/547 |

FOREIGN PATENT DOCUMENTS

| | | | |
|---|---|---|---|
| 181736 | 10/1984 | Japan | 367/199 |

*Primary Examiner*—John Chapman

*Attorney, Agent, or Firm*—Bucknam and Archer

[57] ABSTRACT

The sound producing device is composed of three independent parts: (1) a push-button for generating a sound-wave; (2) an assembly comprising a sound-wave sensing switch, a magnet and magnetic-reed switch, an integrated circuit amplifier and a door bell; and (3) a fixed magnet. The three parts have their own self-sticking glue, so that no wire is required when installed, and it can be adhered on the front of the door, inside the door, and by the side of the door frame, respectively. Dry cells may be located in the interior of the assembly. The device serves several functions because it notifies people (1) that the door is not well closed, (2) that a burglar is trying to get into the house and (3) it serves the normal function of a door bell.

3 Claims, 1 Drawing Sheet

MULTI-FUNCTION ELECTRIC BELL

FIELD OF THE INVENTION

The present invention relates to a multi-function electrical sound producing device, and more particularly to a wireless device which performs the following three functions:

(1) the normal function of a door bell;

(2) preventing any illegal entry by a burglar;

(3) warning the occupant if the door is not closed properly.

Dry cell batteries are used as the power source.

BACKGROUND OF THE INVENTION

For the action of a conventional electrical bell, wire is a must, and generally, A.C. power is used. It does not matter whether a conduit is needed outside or inside the wall, an electrician is needed to design and a install it, which requires labor, material and time. Sometimes, it can even ruin a door or wall and detracts from the exterior appearance of the building. If an A.C. power source is used, any power failure is inevitable and accidental leakage shock could also be a hazard. Also, a conventional electric bell merely serves the normal function of notifying the occupant that someone is at the door and that he must answer.

SUMMARY OF THE INVENTION

Therefore, the main object of this invention is to provide a device which performs several functions. The invention provides a wireless electrical sound producing device which is easily installed. Three separate main parts with self-sticking glue on the back can be used immediately after being pasted by the users themselves on the outer surface of the door, on the inner surface or somewhere adjacent to the side of the door and on the door frame.

Another object of this invention is to provide a wireless electrical sound producing device which can save energy by using a dry cell battery with a voltage of 1.5 V–3.0 V. Being designed this way, the power source circuit is in a normal-open state when in the rest position and no energy is consumed.

Still another object of this invention is to provide a multi-function electric electrical sound producing device whose efficacy is outstanding. Its functions are:

(1): By slightly touching the button on the outside surface of the door, the electric bell inside the door will buzz due to the sensing of the mechanical vibration from the button;

(2) anti-burglar alarm: If people outside the door try to break into the door by destroying the door-lock, this bell rings immediately. If breaking the door-lock continues, the bell will ring continuously until the breaking is stopped;

(3) the warning of door not properly closed: If someone forgets to close the door after it has been opened, the bell will ring to notify the occupants to take action.

DETAILED DESCRIPTION

Figure 1:
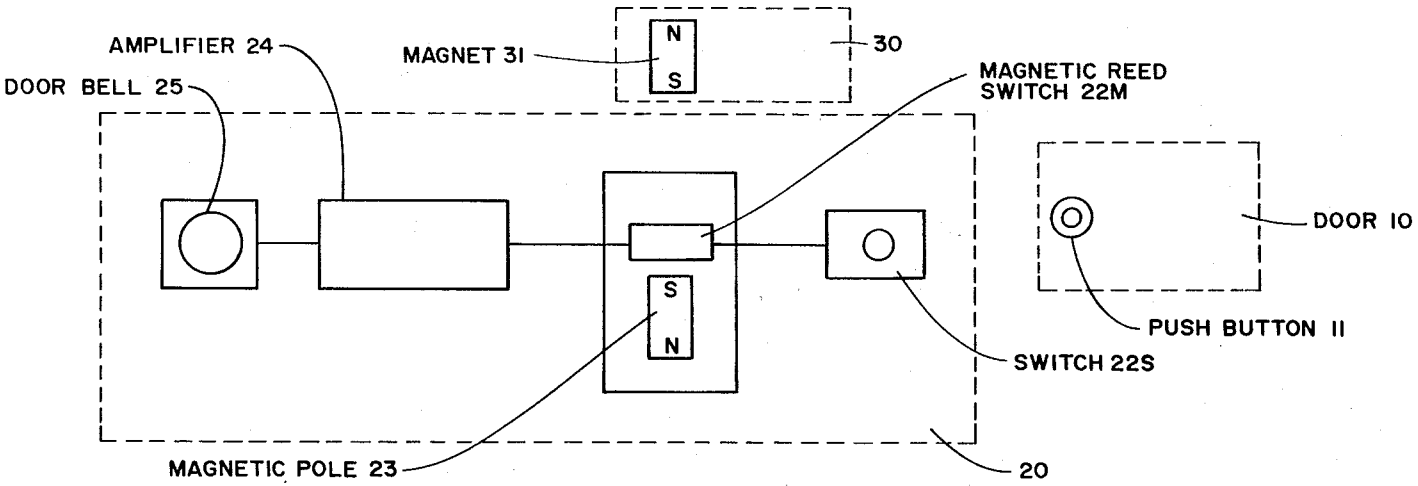
FIG. 1 is a block diagram showing the preferred embodiment of the present invention.
Figure 2:
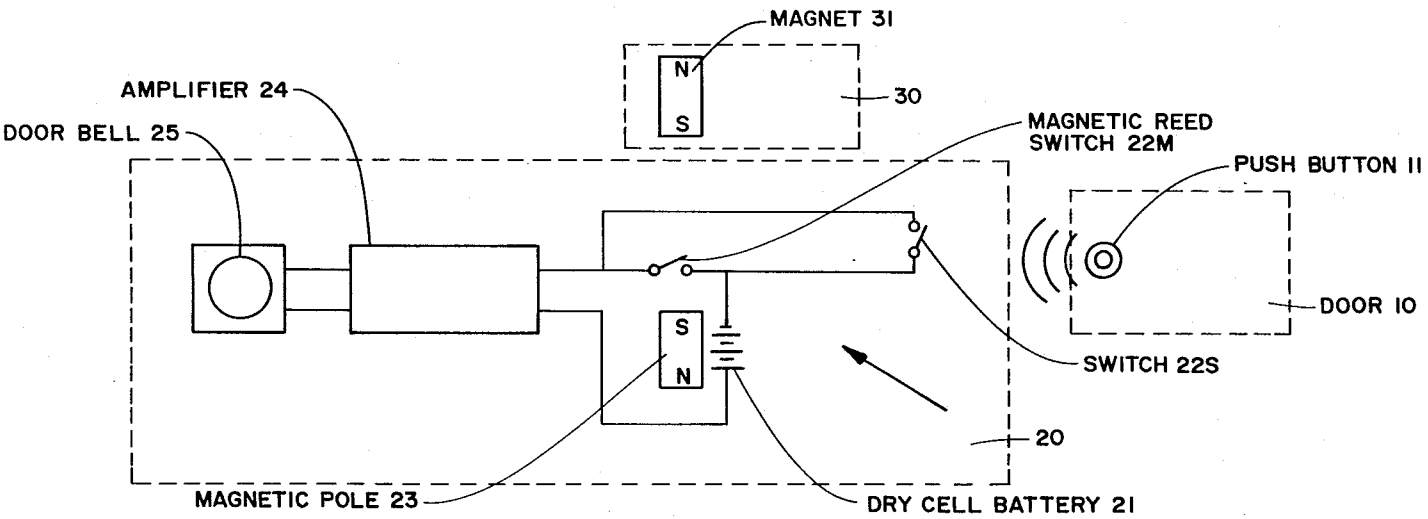
FIG. 2 is a circuit diagram of the preferred embodiment of FIG. 1.

As shown in FIG. 1 and FIG. 2, the electric bell of this invention is composed of three parts, the first part is a push-button 11, located outside the door 10, which will produce a sound-wave through mechanical vibration. No tools or wire are needed and it can be stuck on the door surface by using self-sticking glue.

The second part is an assembly 20 comprising an inner circuit including a D.C. power source of 1.5 V to 3.0 V supplied by a dry cell battery 21, a sound sensing switch 22S, amplifier 24 forming an integrated circuit (IC), and a door bell 25; as well as a magnetic-reed switch 22M which is parallel to the sound-sensing switch 22S. The magnetic-reed switch is subjected to the balanced influences of a magnet 23 in the assembly 20 of the second part and a magnet 31 (i.e. the third part) located somewhere adjacent to the side of the door frame, opposite and aligned with the magnetic pole 23. When the door is closed properly, the magnetic-reed switch 22M is kept normally opened; if the door is not closed properly, the reed switch 22M is closed due to the loss of equilibrium in attraction forces exerted by the magnets 23 and 31, and the electric bell will ring due to the closing of 22M.

Therefore, the functions (1) and (2), i.e. the functions of a conventional door bell and anti-burglar warning are achieved by the vibration initiated by the pushing of the button 11, or any illegal break-in, the soundwave-sensing switch 225 (powered by cell 21), amplifier IC 24 and the electric bell 25.

However, function (3), i.e. the warning of the door not being closed properly is achieved by magnet 31 not being in the normal position, which makes magnet 23 attract the magnetic-reed switch 22M (powered by cell 21) so that the circuit including amplifier 24 and electric bell 25 will be closed causing the bell to ring.

During the rest period, the energy consumed is very limited because the dry cell is not consuming any electrical power due to the normal opening of switches 22S and 22M.

The first, second, and the third parts of this invention have self-sticking glue on their rear face, making installation very easy. Also, since the function is performed through sensing, no wire is required, which is very convenient. Everything can be done without tools. It not only conserves energy but also has the multi-functions of a conventional door bell, anti-burglar alarm and notifies the occupants that the door is not closed properly. The concept, which is novel and practical, is an original idea as far as the applicant knows.

The abovesaid description is made by way of an embodiment; any variation, without departure from the spirit of this invention, made by those who are skilled in this field should be deemed as being covered by the claims of this invention.

I claim:

1. A sound producing device for installation on the surface of a door or window, said door or window having an outer surface, an inner surface and a frame, which comprises three parts: part (1) which is a sound wave generating means comprising a push button for installation on said outer surface of the door or window; part (2) which is an assembly comprising an integrated inner circuit (IC), including a power source (21), a sound wave sensing switch (22S) responsive to mechanical vibration, a magnetic reed switch (22M) electrically parallel to said sound wave sensing switch, a magnet (23) located in proximity of said magnetic reed switch, an amplifier (24) and a door bell (25), said assembly to be located on the inner surface of the door or window, and part (3) which comprises a fixed magnet (31) to be located opposite to said magnetic reed switch and adjacent to the side of the door frame or window, whereby when said door or window is closed, said push button produces a mechanical vibration, the sound wave switch (22) activates the power source and closes the integrated circuit and activates the door bell (25), and whereby said magnetic reed switch is subjected to the balanced influence of said magnet (23) and said magnet (31), and when said door or window is not properly closed, said fixed magnet (31) is displaced from its position aligned with said magnetic reed switch (22M), said magnet (23) attracts said magnetic reed switch (22M), the circuit is closed and the bell rings.

2. The sound producing device according to claim 1 wherein said power source is a dry cell battery.

3. The sound producing device according to claim 1 wherein said parts (1), (2) and (3) have self-sticking glue on the rear face thereof.

* * * * *